US005277486A

United States Patent [19]

Bustos

[11] Patent Number: 5,277,486

[45] Date of Patent: Jan. 11, 1994

[54] MERCHANDISING DISPLAY

[75] Inventor: Rafael T. Bustos, Alpharetta, Ga.

[73] Assignee: L&P Property Management Company, Chicago, Ill.

[21] Appl. No.: 48,585

[22] Filed: Apr. 14, 1993

Related U.S. Application Data

[63] Continuation of Ser. No. 883,686, May 15, 1992, abandoned.

[51] Int. Cl.[5] ..... A47F 3/04; A47F 3/10

[52] U.S. Cl. ..... 312/125; 211/151; 211/59.2; 312/116

[58] Field of Search ..... 312/125, 135, 305, 138.1, 312/116, 45, 42, 97.1, 36, 234; 211/151, 59.2; D9/414, 415, 431; D6/432, 436, 439, 442, 443

[56] References Cited

U.S. PATENT DOCUMENTS

| | | | |
|---|---|---|---|
| Re. 30,706 | 8/1981 | Bustos . | |
| 470,022 | 3/1892 | Tuthill | 312/305 |
| 1,941,906 | 1/1934 | Marinsky | 211/151 |
| 2,066,865 | 1/1937 | Warner | 312/97.1 |
| 2,087,797 | 7/1937 | Cox | 312/36 |
| 2,217,810 | 10/1940 | Pape | 211/151 |
| 4,293,062 | 10/1981 | Bustos . | |
| 4,351,439 | 9/1982 | Taylor . | |
| 4,809,855 | 3/1989 | Bustos . | |

FOREIGN PATENT DOCUMENTS

| | | | |
|---|---|---|---|
| 1315964 | 12/1961 | France | 312/305 |

OTHER PUBLICATIONS

Master-Bilt EAL/EAM-3 Brochure, Display Merchandisers.

*Primary Examiner*—Kenneth J. Dorner
*Assistant Examiner*—Nancy P. Connolly
*Attorney, Agent, or Firm*—Wood, Herron & Evans

[57] ABSTRACT

A method and apparatus for merchandising product by gravity feeding that product to the front of a rotatable shelf. The product is supported upon a shelf which is in turn supported from a low friction support for rotation about an axis slightly tilted relative to a vertical plane with the shelf slightly tilted relative to a horizontal plane. The orientation of the shelf is such that the low point of the shelf is at the front of the shelf so that when displayed product is removed from the front of the shelf, the center of gravity of the shelf shifts and the weight of the product remaining on the shelf causes the shelf to rotate so as to relocate new product to the front of the shelf.

24 Claims, 4 Drawing Sheets

5

MERCHANDISING DISPLAY

This application is a continuation of application Ser. No. 07/883,686, filed May 15, 1992, now abandoned.

FIELD OF THE INVENTION

This invention relates to a display for merchandising products and particularly to a display for merchandising refrigerated products such as refrigerated beverages. More particularly, this invention relates to an improved gravity feed merchandising display for merchandising refrigerated beverage products.

BACKGROUND OF THE INVENTION

Merchandising displays are commonly used in supermarkets as well as in other types of stores to display and merchandise items such as beverages which are generally handled as self-service items. Quite commonly and for many years such items have been displayed and merchandised in racks wherein the products are arranged on shelves in adjacent rows parallel to the shelf's front edge with the shelf sloping downwardly from the rear to the front such that when customers remove product from the front edge of the shelf, the product to the rear of the removed product automatically slides forward to the front of the shelf. Such an arrangement for displaying and merchandising beverages is disclosed, for example, in U.S. Pat. No. 4,809,855, assigned to the assignee of this application. In this patent, sliding of the displayed merchandise to the front of the shelf is facilitated by a low friction slip surface mounted upon the top of the shelf for supporting the displayed product.

Another alternative to the use of a slip surface to facilitate gravity feed of displayed merchandise to the front of a sloping shelf is disclosed in Reissue U.S. Pat. No. RE30,706, also assigned to the assignee of this application. According to the disclosure of this patent, the displayed product is mounted upon a plurality of parallel endless conveyor belts arranged so as to be movable in a direction perpendicular to the shelf's front edge. The inside surface of the belts which rides over a supporting floor has a low coefficient of friction while the outside surface of the belt upon which the displayed product rests has a higher coefficient of friction. When the forwardmost displayed product on the belt is removed, the low friction coefficient on the belt's inside surface facilitates gravity feed or movement of the remaining product supported upon the belt, causing the belt and remaining product to slide forwardly over the stationary supporting surface to the front of the supporting surface until the product contacts a stationary abutment at the front of the sloping supporting surface. The use of the belt according to the disclosure of this patent enables the product to slide forwardly to the front of the shelf without any relative movement between the products and potential for impact of one product against another during the course of forward movement on the sloping shelf.

Another patent which discloses another technique for automatically moving product to the front of a shelf of a display in response to removal of the front product on the shelf is disclosed in U.S. Pat. No. 4,351,439, also assigned to the assignee of this application. According to the disclosure of this patent, the product is supported upon a belt on a horizontal shelf. The rearwardmost product in a column of products supported upon the belt is biased forwardly by a spring, similar to a window shade spring such that when the forwardmost product is removed from the column supported upon the belt, the belt is moved forwardly until the next forwardmost product abuts a stationary abutment at the front of the shelf.

Generally, gravity or spring biased automatic forward feed displays wherein the product is automatically moved to the front of a shelf in response to removal of the forwardmost displayed product on the shelf have been utilized in open-type displays wherein the forwardmost products are easily accessible. Such automatic forward feed displays have also been used in refrigerated cabinets, but when so used, the design of the cabinet has been severely restricted by the need to have large doors at the front of the cabinet in order to provide access to a relatively large quantity of stored product within the cabinet. Otherwise expressed, if there are ten columns of product displayed in a prior art refrigerated cabinet, then the access door of the cabinet has been ten columns wide. This means that if the product is refrigerated, a large quantity of refrigerated air necessarily escapes every time the door is opened. Or alternatively, if a small door is to be utilized, then only a relatively small number of columns of product may be stored within the cabinet and automatically moved to the front so as to be accessible through that small door.

It has therefore been an objective of this invention to provide an improved method and apparatus for gravity feeding product to the front of a merchandising display so as to enable a greater quantity of product to be accessed through a smaller opening, or alternatively, a greater quantity of product to be accessed at the front of the merchandising display.

Still another objective of this invention has been to provide an improved rotatable shelf display which is operative to automatically gravity feed product to the front of the rotatable shelf.

Still another objective of this invention has been to provide a refrigerated merchandising display wherein a large quantity of product may be gravity fed to the front of the refrigerated display and accessed through a relatively small door.

The invention of this application which accomplishes these objectives comprises a merchandising display having a rotatable shelf assembly that automatically gravity feeds displayed product to the front of the shelf as the product is successively removed from the front of the shelf by a customer. This display comprises a housing for rotatably supporting at least one shelf and a shelf supported from the housing in a plane slightly tilted out of a horizontal plane for rotation about an axis which is slightly tilted relative to a vertical plane, the tilt of the shelf being such that the lowest point on the tilted shelf is located at the front of the shelf such that when product supported on the shelf is removed from the front of the shelf the weight of the remaining product on the shelf automatically causes the shelf to rotate to reposition the remaining product at the front of the shelf. Otherwise expressed, when product is removed from the front of the shelf, the shelf automatically rotates in response to removal of the product from the front to locate new product at the front of the shelf.

The invention of this application also comprises a method of gravity feeding displayed product to the front of a rotatable shelf of a merchandising display as product is successively removed from the front of the shelf by a customer. This method comprises supporting the shelf from a low friction support for rotation about an axis slightly tilted relative to a vertical plane with the shelf slightly tilted relative to a horizontal plane, the orientation of the shelf being such that the low point on the shelf is at the front of the shelf so that when displayed product is removed from the front of the shelf, the weight of product remaining on the shelf causes the shelf to rotate so as to relocate new product to the front of the shelf.

The primary advantage of the invention of this application is that it enables a maximum quantity of product to be automatically gravity fed to a single location at the front of the display. When utilized in a refrigerated cabinet, this invention enables a large quantity of product to be stored within the cabinet and gravity fed to one or more openings or doors on the cabinet which may be minimally sized while still facilitating access to a large quantity of product.

BRIEF DESCRIPTION OF THE DRAWINGS

These and other objects and advantages of this invention will become more readily apparent from the following description of the drawings in which.

DETAILED DESCRIPTION OF THE INVENTION

Figure 1:
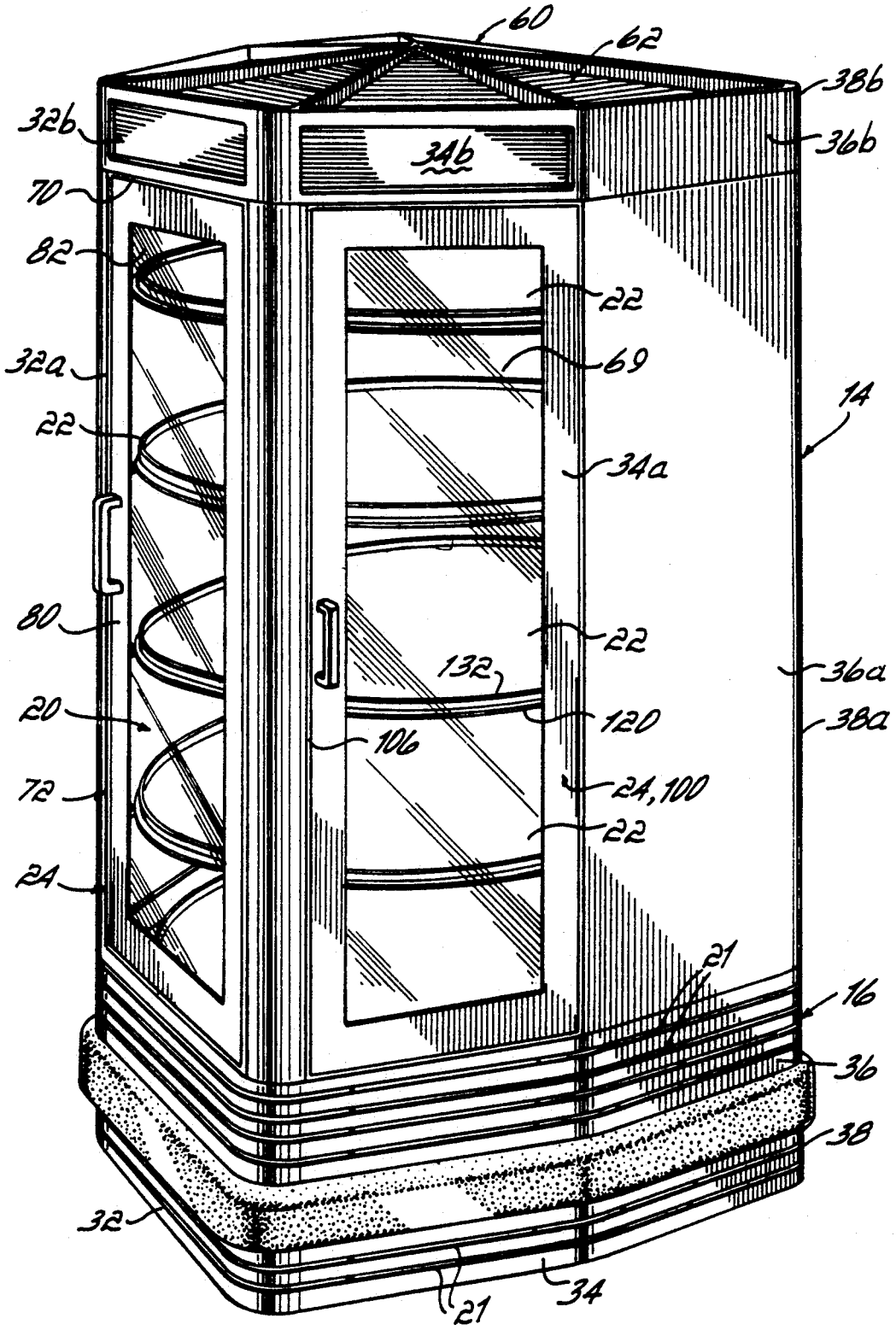
FIG. 1 is a perspective view of a merchandising display incorporating the invention of this application.
Figure 4:
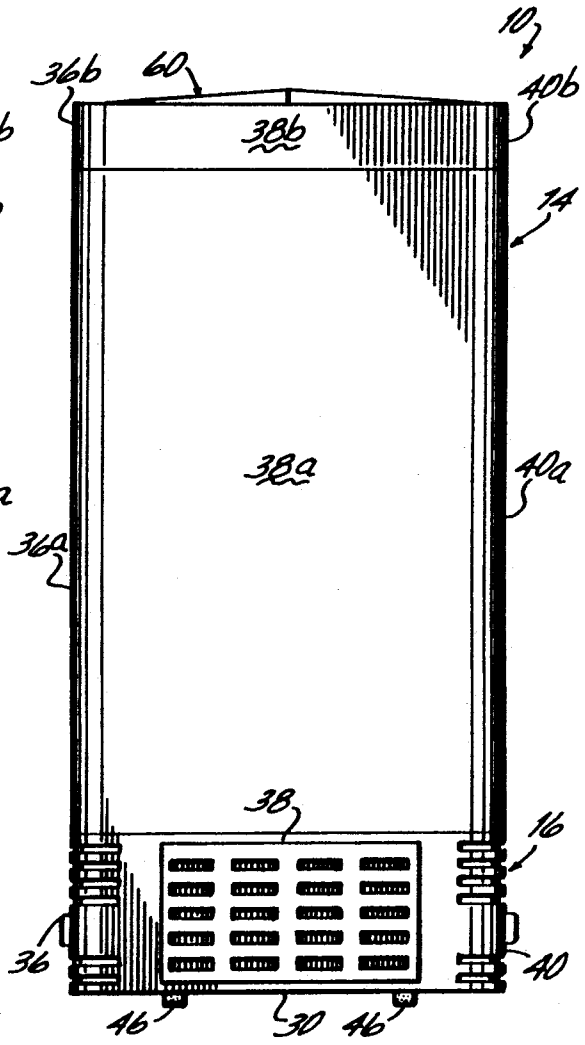
FIG. 4 is a rear elevational view thereof.
Figure 3:
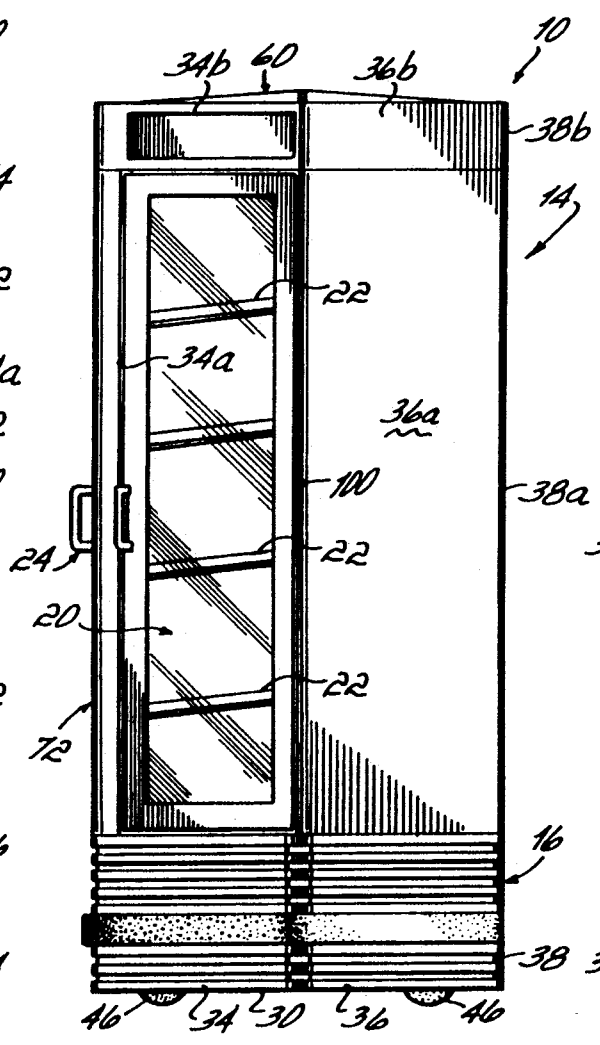
FIG. 3 is a side elevational view thereof.

Referring first to FIG. 1, there is illustrated a refrigerated merchandising display 10 incorporating the invention of this application. This display is intended to merchandise refrigerated beverages as, for example, refrigerated soft drinks contained in bottles or containers 12. It could as well, though, be utilized to merchandise other products, whether refrigerated or not.

The merchandising display 10 comprises a housing 14 in the base 16 of which there is located a base storage compartment 15 (FIG. 5) for the compressor portion 19 of a refrigeration unit 18. The upper portion of this housing 14 defines an enclosed compartment 20 for the storage and display of the refrigerated product 12. Within the compartment 20 there are a plurality of rotatable shelves 22 upon which the product 12 is supported. Access to the product in the compartment 20 is gained through one or more doors 24 located on the front side of the housing.

The base 16 of the housing 14 comprises a bottom wall 30, a top wall 31, and six vertical walls 32, 34, 36, 38, 40 and 42. These vertical walls comprise a front wall 32, a pair of side walls 34 and 42 which diverge rearwardly from the front wall (see FIG. 6), a pair of parallel rear side walls 36, 40, and a rear wall 38. Contained within the base storage compartment 15 defined by these walls is the compressor 19 of refrigeration unit 18 and a fan 44 operative to direct ambient air over fins of the compressor to cool it. This ambient air is permitted to flow into and out of the base storage compartment 15 through openings or louvers 21 in the vertical walls of the base 16.

The base 16 is preferably supported upon wheels or casters 46 which extend downwardly through the bottom wall 30 of the base. These wheels 46 are rotatably mounted in brackets 48 secured to the bottom wall 30 of the housing 14 such that the wheels 46 are free to rotate and enable the display 10 to be easily moved within a supermarket or other merchandising facility within which the display 10 is utilized.

Mounted atop the base 16 is the upper portion 50 of the housing 14. This upper portion encloses the storage and display compartment 20 within which the refrigerated product is stored and displayed.

This upper portion 50 of the housing is of the same hexagonal cross-sectional configuration as the base. It comprises a front wall 32*a*, a pair of front side walls 34*a*, 42*a* which diverge rearwardly and outwardly from the side edges of the front wall 32*a*, a pair of parallel rear vertical walls 36*a*, 40*a* which extend rearwardly from the rear edge of the diverging walls 34*a*, 42*a*, and a rear wall 38*a* which extends between and interconnects the rear edge of the rear walls 36*a*, 40*a*.

Figure 5:
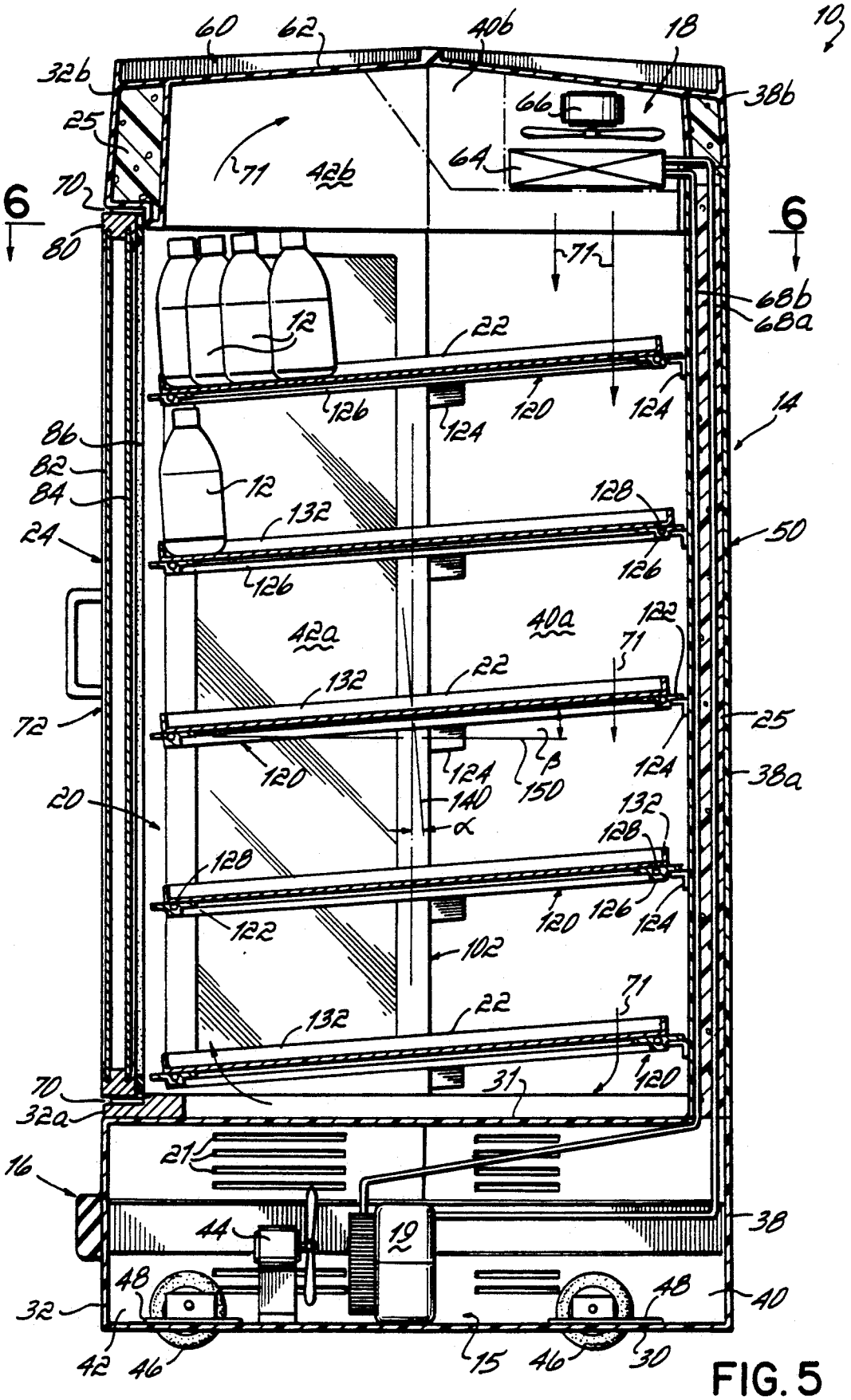
FIG. 5 is a cross-sectional view taken on line 5—5 of FIG. 2.
Figure 6:
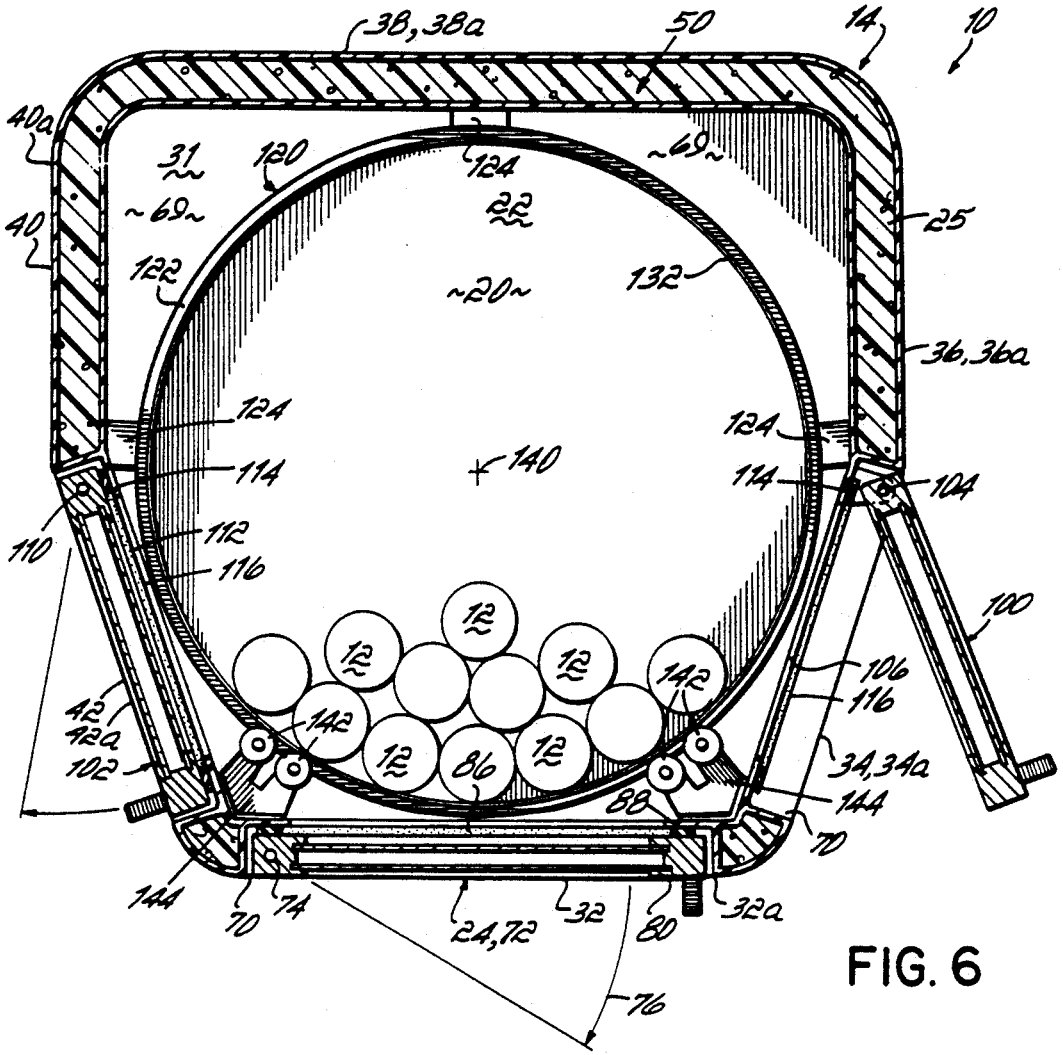
FIG. 6 is a cross-sectional view taken on line 6—6 of FIG. 5.

As may be seen most clearly in FIGS. 5 and 6, all of the vertical walls of the upper portion 50 of the housing 14 are of double thickness and preferably have insulation 25 placed therebetween so as to minimize refrigeration loss through the walls of the housing. Each of the outermost walls of the double thickness vertical walls of the housing is preferably coextensive with one of the vertical walls 32, 34, 36, 38, 40 and 42 of the base. Thus, the side walls of the upper portion 50 of the housing 14 form a general continuum with the coextensive walls of the base 16.

The housing 14 also includes a cap 60 mounted atop the vertical walls of the upper portion 50 of the housing 14. This cap 60 comprises six vertical sides 32*b*, 34*b*, 36*b*, 38*b*, 40*b*, and 42*b* coextensive with the vertical walls of the upper portion 50 of housing 14, and a top wall 62 which encloses the compartment 20 of the housing. All of the vertical walls of the cap 60 are double thickness walled and preferably include insulation between the double thickness walls in the same way that the walls of the upper portion of the housing 14 are similarly double walled. The vertical walls of the cap 60 all include an outer wall which is coextensive with the outer wall of the upper portion 50 of the housing 14 and forms a continuum therewith.

Mounted within the cap 60 there is a heat exchanger or radiator 64 and a fan 66. The heat exchanger 60 is connected by capillary tubes 68*a* and 68*b* to the compressor 19 in the base 16. Thereby cooled air may be directed by the fan 66 through the heat exchanger 64 downwardly over the back of the shelves 22 through the space or open areas 69 (See FIG. 6) between the shelves and the inside walls of the compartment 20 and upwardly over the front of the shelves as indicated by the arrows 71 in FIG. 5.

The front wall 32*a* of the upper portion 50 of housing 14 has a rectangular opening 70 formed therein. Within this opening there is pivotly mounted a door 72 which, when closed, encloses the compartment 20 of the housing 14 and when opened about the pivots or hinges 74 (as indicated by the arrow 76 in FIG. 6) facilitates access to product such as bottles 12 located on the front of the shelves 22.

Figure 2:
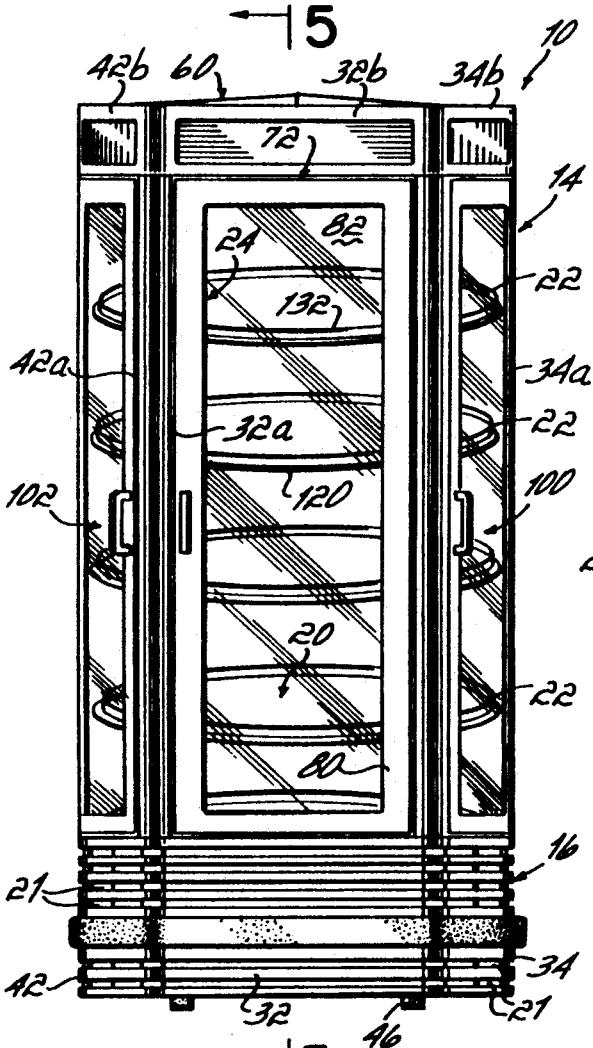
FIG. 2 is a front elevational view thereof.

As may be seen most clearly in FIGS. 2, 5 and 6, the door 72 comprises four metal extrusions interconnected at their ends to form a rectangular door frame 80. Mounted within this door frame there is a pair of spaced transparent glass or plastic windows 82, 84 through which product contained within the compartment 20 may be viewed.

As best illustrated in FIG. 6, there is a resilient door seal 86 located around the periphery of the opening 70 in the front wall 32*a* of the upper portion 50 of the housing 14. This seal 86 is secured to an inwardly extending flange 88 of the opening 70. The inner edge of this flange 88 defines the opening 70 through which access may be gained to the interior compartment 20 of the housing.

In the preferred embodiment of the invention illustrated in the drawings, there are two additional doors 100, 102 mounted in the diverging vertical walls 34*a*, 42*a* of the upper portion of the housing. These doors 100, 102 are identical to the door 72 and are similarly pivotly mounted to the diverging walls 34*a*, 42*a* of the housing. Specifically, the door 100 is mounted by pivot pins or hinges 104 to the housing for pivotal movement about the hinge 104 so as to facility access to the interior compartment 20 of the housing through an opening 106 in the wall 34*a*. And, similarly, the door 102 is mounted on pivot pins or hinges 110 for pivotal movement about the hinge 110 so as to enable access to the interior compartment 20 of the housing through an opening 112 in the wall 42*a*. The openings 106 and 112 are rectangular in configuration and include inwardly extending flanges 114 to which seals 116 are secured and against which the door rests when in the closed position.

All three of the doors 72, 100, 102 are generally biased to the closed position by conventional closures and are maintained in the closed position by magnets or by conventional latches. Since the closures and latches form no part of the invention of this application, they have not been illustrated herein.

The rotatable shelves 22 are located within the compartment 20 of the housing 14. In the illustrated embodiment, there are five such rotatably mounted shelves. Since these shelves are all identical and are identically mounted within the compartment 20 of the housing 14, only one will be described in detail. It will be appreciated, though, that additional parallel shelves may be similarly mounted within the compartment 20, the number of such shelves depending upon the application and the size of the merchandising display 10.

Each shelf 22 is generally solid, planar and circular in configuration as may be best seen in FIGS. 5 and 6. And, each shelf is supported from an annular support ring 120 which is in turn fixedly supported to the inside wall of the housing 14 by brackets 124. These annular rings 120 comprise a generally planar section 122 which rests atop and is supported from a horizontal flange of the brackets 124. These brackets 124 also have depending outer vertical flanges which are fixedly secured to the inside wall of the housing 14 as by welding or other fixed attachment. Each planar section 122 of the shelf supporting ring includes a depression 126 within which there are located a plurality of rollers 128. The shelves 22 rest upon and are rotatable over the rollers 128 of the supporting rings 120.

Each shelf 22 has a vertically upstanding annular flange 132 which serves as a bumper or stop for products supported upon the shelf. This flange functions to prevent product from sliding off of the shelf. To preclude lateral sliding movement of the shelf 22 and ensure that the shelf rotates about an axis 140 at the center of each shelf and does not slide laterally relative to that axis, there are pairs of rotatable bumpers 142 spaced about the periphery of each shelf and supported upon brackets 144. These bumpers 142 are best illustrated in FIG. 6 wherein it will be seen that the brackets 144 are fixedly attached to the housing 14 at the corners or intersections of the front wall 34*a* and diverging walls 34*a*, 42*a* of the housing. These rotatable bumpers 142 engage the vertical flange 132 of the shelf and preclude lateral sliding movement of the shelf relative to its axis.

With particular reference to FIG. 5, it will be seen that the rings 120 upon which the shelves 22 are supported are tilted or sloped at an angle $\beta$ relative to a horizontal plane 150 which passes through the front edge of the ring 120. In one preferred embodiment of the invention, the angle $\beta$ defined between the horizontal plane 150 and the plane of the supporting ring 120 is five degrees. As may be seen most clearly in FIG. 5, this five degree angled supporting ring slopes downwardly and forwardly from the back to the front of the shelf such that the shelf rotates about the axis 140 which also defines a five degree angle $\alpha$ between the axis 140 of rotation of the shelves and a vertical axis through the center of each shelf.

In the preferred embodiment of the invention, the angles $\alpha$ and $\beta$ defined by the shelf relative to a horizontal plane through the center of the shelf and by the axis of rotation of the shelves and a vertical plane through the axis at the center of the shelf is five degrees. This angle, though, may vary from one application to another depending upon the weight of the products 12 displayed and mounted upon the top of the shelves 22 and the frictional resistance to rotation of the shelves upon the supporting rings. Five degrees, though, has been found to be the optimal degree of slope or angulation of the shelves for one application in which beverage bottles are displayed and merchandised in the merchandising display 10 of this invention.

Figure 7:
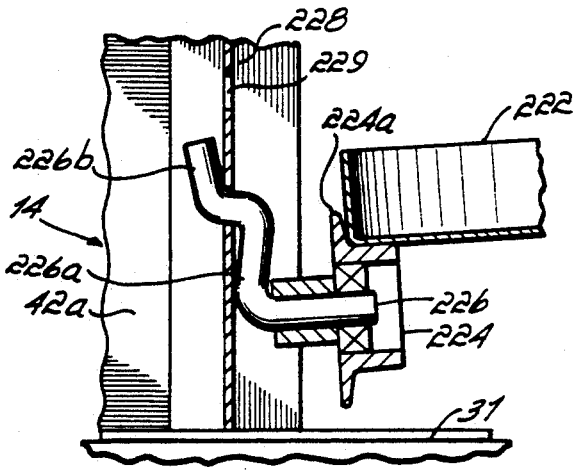
FIG. 7 is a cross-sectional view of a second modification of roller support for supporting the rotary shelves of the display.

As an alternative to supporting the shelves 20 from the annular rings 120, the shelves may be supported as illustrated in FIG. 7 by rollers 224 mounted upon vertical posts 228 contained within the compartment 20 of the housing and supported by the top wall 31 of the base 16 and the inside side walls 42*a* of the housing 14. As illustrated in FIG. 7, the shelves 22 are supported by the rollers 224 located beneath the shelves 22 and in turn rotatably supported upon axles 226. These axles are in turn supported from the vertical posts 228 which extend vertically on the inside of the housing 14. Preferably there are at least four vertical posts 228 located on the inside of the compartment 20 so that at least four rollers 224 support each shelf 22.

In the embodiment of FIG. 7, the rollers 224 each have a vertical flange 224*a* which engages the outer edge of the shelf 22 to limit and prevent lateral sliding movement of the shelf and thus ensure that the only shelf movement is rotary movement about the shelf axis 140. And, to facilitate vertical adjustment of the shelves in this embodiment, the axles 226 of each roller have a vertical extension 226*a* with an offset 226*b* at the upper end thereof to enable the axles to be located and locked in any one of multiple equidistantly spaced vertical holes 229 in the posts 228.

In the use of the merchandising display 10 of this invention, product 12 to be merchandised or sold from the display 10 is mounted upon the rotatable shelves 22. This product is loaded through the front door 72 of the display or, if as in the preferred embodiment, there are multiple doors in the front of the display, through one or more of the doors. After the shelves are loaded and the door closed, the refrigeration unit 18 is utilized to cool the compartment 20 within the housing 14. This refrigeration unit is operative to pump cool air downwardly through the heat exchanger 64 into the rear of compartment 20 within the housing and upwardly over the front of the shelves as illustrated by the arrows 71 of FIG. 5. Thereby, cooled air circulates in to the compartment 20 to maintain the temperature in the compartment 20 in the preferred range from 36° F. to 42° F.

When the door 72 or one of the other doors 101 or 102 is opened to gain access to the interior compartment 20 of the housing 14, some refrigerated air escapes, but because of the relatively small size of the opening created by opening of the door, the quantity of escaping refrigerated air is minimized. With the door open, one or more bottles or products 12 may be removed from one of the shelves. When that product is removed from the front of the shelf, it causes a shifting in the center of gravity of the shelf and the product supported atop the shelf. Because of that shift of the center of gravity, the shelf rotates so as to relocate the shelf with new product located immediately adjacent the inside surface of the front door 72. The relatively low coefficient of friction between the shelf and its supporting ring 120 or rollers 224 facilitates this rotational and automatic movement of the shelf in response to removal of product from the front of the shelf. Otherwise expressed, gravity automatically affects repositioning of the shelf upon removal of bottles of product 12 from the front of the shelf so that new bottles are immediately positioned adjacent the inside of the door 72 at the front of the shelf. This automatic realignment of the shelf occurs as a consequence of the front edge of the sloping surface being the lowest point on the shelf and that point being located immediately adjacent the vertical center line of the front door 72.

While I have described only two preferred embodiments of my invention, persons skilled in the art to which this invention pertains will readily appreciate changes and modifications which may be made without departing from the spirit of my invention. For example, the doors 100, 102 may be omitted from the housing and only a single door 72 utilized, depending upon the application. But, in any event, the automatic repositioning of the sloping shelves will occur in response to removal of product from the front of the shelf. Additionally, the merchandising display 10 may be utilized for displaying and merchandising products which are not refrigerated and/or products other than beverage containers. Therefore, I do not intend to be limited except by the scope of the following appended claims:

I claim:

1. A liquid beverage container merchandising display with an improved rotatable shelf assembly that automatically gravity feeds liquid beverage container product to the front of the shelf as product is successively removed from the front of the shelf by a customer, which merchandising display comprises a housing for rotatably supporting at least one shelf, a shelf supported from said housing in a plane slightly tilted out of a horizontal plane, shelf supporting means for supporting said shelf for free rotation through more than 180 degrees about an axis slightly tilted relative to a vertical plane, the tilt of such shelf being such that the lowest point on the tilted shelf is located at the front of the shelf, such that when product is supported on the shelf, the weight of the product on the shelf will cause the shelf to freely rotate until the heaviest portion of the shelf and the product are located at the front of the shelf, and when product is removed from the front of the shelf, the shelf and product will automatically and freely rotate in response to removal of the product from the front to locate new product at the front of the shelf, and said shelf having an outer radial periphery, said shelf supporting means supporting said shelf for rotation solely from adjacent the outer radial periphery of said shelf whereby relatively heavy beverage containers may be supported on said shelf without impeding free rotation of the shelf.

2. The merchandising display of claim 1 wherein said housing supports a plurality of vertically stacked shelves, each of said shelves being rotatably supported from said housing in parallel planes slightly tilted to horizontal planes and rotatable about an axis slightly tilted relative to a vertical plane.

3. The merchandising display of claim 1 wherein said housing defines an enclosed compartment, and a door mounted upon said housing at the front of the housing such that product rotated to the front of said shelf by gravity is accessible through said door.

4. The merchandising display of claim 3 wherein said housing encloses a refrigeration unit, said enclosed compartment being refrigerated by said refrigeration unit.

5. The merchandising display shelf of claim 1 wherein said shelf is supported for rotation from a plurality of low friction roller supports located adjacent to said outer radial periphery of the shelf.

6. A merchandising display with an improved rotatable shelf assembly that automatically gravity feeds product to the front of the shelf as product is successively removed from the front of the shelf by a customer, which merchandising display comprises a housing having an enclosed display compartment, a shelf freely rotatably supported from said housing within said compartment, a door mounted upon a front side of said housing through which access may be gained to said compartment, shelf supporting means for supporting said shelf from said housing in a plane slightly tilted out of a horizontal plane, said shelf supporting means supporting said shelf for free rotation through more than 180 degrees about an axis slightly tilted relative to a vertical plane, the tilt of such shelf being such that the lowest point on the tilted shelf is located at the front of the shelf, such that when product is supported on the shelf, the weight of the shelf and the product on the shelf will cause the shelf to rotate to locate the product at the front of the shelf where it is accessible through said door, and when product is removed from the front of the shelf, the weight of the shelf and the product remaining on the shelf will automatically rotate the shelf in response to removal of the product from the front to locate the heaviest portion of the shelf and the remaining product at the front of the shelf, and said shelf having an outer radial periphery, said shelf being supported for rotation solely from adjacent the outer radial periphery of said shelf.

7. The merchandising display of claim 6 wherein said housing supports a plurality of vertically stacked shelves within said display compartment, each of said shelves being rotatably supported from said housing in parallel planes slightly tilted to horizontal planes and rotatable about an axis slightly tilted relative to a vertical plane.

8. The merchandising display of claim 6 wherein said housing encloses a refrigeration unit, said enclosed display compartment being refrigerated by said refrigeration unit.

9. The merchandising display shelf of claim 6 wherein said shelf is supported for rotation from a plurality of low friction roller supports located adjacent to said outer radial periphery of the shelf.

10. The merchandising display of claim 9 wherein there are three doors mounted in said housing, there being a second door mounted in one of said diverging sides and a third door mounted on the other of said diverging sides.

11. The merchandising display of claim 6 wherein said housing when viewed in top plane view has a front side within which said door is located, a pair of sides diverging rearwardly away from opposite edges of said front side, a pair of parallel sides extending rearwardly from rear edges of said diverging sides and a rear wall connecting rear edges of said parallel sides.

12. The method of gravity feeding refrigerated displayed product to the front of an enclosed refrigerated display compartment of a merchandising display having an access door on the front side through which access may be gained to the enclosed refrigerated display compartment, which merchandising display includes a plurality of independently rotatable display shelves upon which product is displayed, which shelves are operative to rotate and position new product adjacent the door as product is removed from the front of the shelf by a customer, which method comprises supporting the shelves from low friction supports located about the radial periphery of the shelves, which shelves are supported for free rotation through more than 180 degrees about axes slightly tilted relative a vertical plane with the shelves being slightly tilted relative to horizontal planes, the orientation of the shelves being such that the low point on the shelves is at the front of the shelves so that when displayed product is removed from the front of a shelf, the weight of product remaining on the shelf from which the product was removed causes the shelf to freely rotate so as to relocate the heaviest portion of the shelf and new product to the front of the shelf adjacent the door.

13. A merchandising display comprising:

a housing having an enclosed display compartment, at least one circular shelf supported by said housing and contained within said compartment, and a door mounted on a front side of said housing through which access may be gained to said compartment, wherein said housing when viewed in top plan view has a pair of sides diverging rearwardly away from opposite edges of said front side, a pair of substantially parallel sides extending rearwardly from rear edges of said diverging sides and a rear wall connecting rear edges of said parallel sides.

14. The merchandising display of claim 13 wherein there are at least three doors mounted in said housing with at least one door mounted in said front side and one door mounted in each of said diverging sides.

15. The merchandising display of claim 13 wherein said rear wall is substantially parallel to said front side of said housing.

16. The merchandising display of claim 13 wherein said compartment contains a plurality of vertically spaced circular shelves freely rotatably supported by said housing.

17. The merchandising display of claim 13 further comprising:

a plurality of vertically spaced circular shelves supported by said housing and contained within said compartment thereby creating a pair of air circulation paths between rear peripheral edges of said shelves and said parallel sides and rear wall of said housing.

18. The merchandising display of claim 17 further comprising a refrigeration unit including fan means contained in a rear portion of said housing for directing cooled air into said air circulation paths.

19. The merchandising display of claim 13 wherein said shelves are freely rotatably supported by said housing within said compartment.

20. A merchandising display comprising:

a housing having an enclosed display compartment, said housing when viewed in top plan view having a pair of sides diverging rearwardly away from opposite edges of a front side, a pair of substantially parallel sides extending rearwardly from rear edges of said diverging sides and a rear wall connecting rear edges of said parallel sides, at least one circular shelf supported by said housing and contained within said compartment, and at least three doors mounted in said housing with at least one door mounted in said front side and one door mounted in each of said diverging sides, wherein said rear wall is substantially parallel to said front side of said housing.

21. The merchandising display of claim 20 wherein said compartment contains a plurality of vertically spaced circular shelves freely rotatably supported by said housing.

22. The merchandising display of claim 21 further comprising:

a plurality of vertically spaced circular shelves supported by said housing and contained within said compartment thereby creating a pair of air circulation paths between rear peripheral edges of said shelves and said parallel sides and rear wall of said housing.

23. The merchandising display of claim 22 further comprising a refrigeration unit including fan means contained in a rear portion of said housing for directing cooled air into said air circulation paths.

24. The merchandising display of claim 23 wherein said shelves are freely rotatably supported by said housing within said compartment.

* * * * *